US006032342A

United States Patent [19]

Kawabe et al.

[11] Patent Number: 6,032,342

[45] Date of Patent: Mar. 7, 2000

[54] MULTI-FILAMENT SPLIT-YARN SHEET AND METHOD AND DEVICE FOR THE MANUFACTURE THEREOF

[75] Inventors: Kazumasa Kawabe; Shigeru Tomoda, both of Sakai-gun, Japan

[73] Assignee: Fukui Prefecture, Fukui, Japan

[21] Appl. No.: 08/981,447

[22] PCT Filed: Apr. 25, 1997

[86] PCT No.: PCT/JP97/01451

§ 371 Date: Dec. 22, 1997

§ 102(e) Date: Dec. 22, 1997

[87] PCT Pub. No.: WO97/41285

PCT Pub. Date: Nov. 6, 1997

[30] Foreign Application Priority Data

May 1, 1996 [JP] Japan ..... 8-135798

[51] Int. Cl.[7] ..... D01D 11/02

[52] U.S. Cl. ..... 28/283; 226/97.4

[58] Field of Search ..... 28/282, 283, 220, 28/103; 428/114; 442/366, 341, 345, 344, 346, 381, 387, 367, 368, 369; 226/7, 97.4; 19/66 T, 66 R; 264/211.14

[56] References Cited

U.S. PATENT DOCUMENTS

| | | | |
|---|---|---|---|
| 1,814,644 | 7/1931 | Stoddard, Jr. | 442/366 |
| 3,325,906 | 6/1967 | Franke | 19/299 |
| 3,341,394 | 9/1967 | Kinney | 442/366 |
| 3,505,155 | 4/1970 | Balch et al. | 28/283 |
| 3,523,059 | 8/1970 | Coates | 28/283 |
| 3,698,039 | 10/1972 | Kalwaites | 28/282 |
| 3,953,909 | 5/1976 | Yazawa et al. | 28/282 |
| 4,179,776 | 12/1979 | Wortman | 28/283 |
| 4,992,323 | 2/1991 | Vogelesang et al. | 442/367 |
| 5,060,351 | 10/1991 | Street | 28/282 |
| 5,182,839 | 2/1993 | Stuart | 28/283 |
| 5,219,633 | 6/1993 | Sabee | 428/114 |
| 5,446,952 | 9/1995 | Kim et al. | 28/283 |
| 5,486,411 | 1/1996 | Hassenboehler, Jr. et al. | 442/345 |

FOREIGN PATENT DOCUMENTS

| | | |
|---|---|---|
| 57-77342 | 5/1982 | Japan . |
| 6-158503 | 6/1994 | Japan . |

*Primary Examiner*—Amy Vanatta
*Attorney, Agent, or Firm*—Ronald R. Snider; Snider & Associates

[57] ABSTRACT

The present invention aims to provide a method of producing a high-quality multi-filament spread sheet by spreading the filaments in such a manner that they are orderly disposed in parallel to each other without the quality deterioration and an apparatus used in the same as well as a multi-filament spread sheet produced in the same. The method and apparatus embodied in the present invention are intended to spread the filaments widthwise by subjecting a multi-filament oversupplied by a certain amount under a feeding control mechanism from a yarn supply section to a yarn winding section to air blowing crosswise with the multi-filament so as to transform the filaments into a multi-filament spread sheet. With this method and apparatus, it becomes possible to obtain various types of multi-filament spread sheets.

14 Claims, 18 Drawing Sheets

Fig. 32

| Type of Multifilament | Initial width $W_1$ (mm) | Preliminary Extension (mm) | Air Spread | | | |
|---|---|---|---|---|---|---|
| | | | Conditions | | Spread Width $W_2$ (mm) | Ratio $W_2/W_1$ |
| | | | Bending (mm) | Air Vel. (m/s) | | |
| CF 6K (φ7μm、6000fila) | 3.5 | 5.0 | 8.0 | 50.0 | 10.4 | 2.97 |
| CF12K (φ7μm、12000fila) | 6.1 | 10.0 | 8.0 | 50.0 | 19.8 | 3.25 |
| GF (φ13μm、2000fila) | 2.6 | 4.8 | 8.0 | 50.0 | 13.3 | 5.12 |
| GF (φ17μm、2000fila) | 3.0 | 5.9 | 8.0 | 50.0 | 14.9 | 4.97 |

Fig. 33

| Type of Multifilament | Initial width $W_1$ (mm) | Roller Spread | | | |
|---|---|---|---|---|---|
| | | Conditions | | Spread Width $W_2$ (mm) | Ratio $W_2/W_1$ |
| | | Diam. of Roller (mm) | Num. of Rollers | | |
| CF 6K (φ7μm、6000fila) | 3.5 | 12.0 | 5 | 6.7 | 1.91 |
| CF12K (φ7μm、12000fila) | 6.1 | 12.0 | 5 | 11.9 | 1.95 |
| GF (φ13μm、2000fila) | 2.6 | 12.0 | 5 | 5.3 | 2.04 |
| GF (φ17μm、2000fila) | 3.0 | 12.0 | 5 | 6.2 | 2.06 |

MULTI-FILAMENT SPLIT-YARN SHEET AND METHOD AND DEVICE FOR THE MANUFACTURE THEREOF

BACKGROUND OF THE INVENTION

The present invention relates to a new technology for producing a spread sheet made of a multi-filament (also including a tow spread sheet) comprising plural filaments combined together, more specifically, it relates to an epoch-making method of efficiently mass-producing a high-quality multi-filament spread sheet whose filaments are spread in such a manner that they are orderly disposed in parallel to each other without the quality deterioration by using a ready-made multi-filament as a production material, for instance, such a multi-filament spread sheet as being excellent in impregnation with resin and filament alignment which are indispensable for a supplemental fiber material for reinforcing a matrix so as to produce a complex material and the apparatus used in the same as well as the multi-filament spread sheet produced in the same.

In recent years, there have been developed and sold on the market a number of complex materials where a carbon fiber, a glass fiber or aromatic polyamide filament such as KEVLAR 49 are mixed with a matrix such as a synthetic resin and the like or interposed between the layers of the matrix for reinforcement.

Because those complex materials show excellent performance in such aspects as durability, heating and corrosion resistance, electrical characteristics and weight reduction, such various industries as aerospace, inland transportation, shipping, construction, civil engineering, industrial parts production, sports goods are selectively using such complex materials as mentioned above in accordance with their type of production so that those complex materials are in acute demand on the market.

In this connection, there are such practical forms of use of those fibers for reinforcing a matrix as plural filaments either disposed in a required width or cut off in a fixed size or processed in cloth status like woven, knitted, braided fabric or nonwoven fabric. Those fibers are either directly complexed with a matrix or processed into a work-in-process called preimpregnation by impregnating a sheet or a woven fabric and so forth on which plural filaments are regularly disposed with a synthetic resin. After the required number of said works-in-process is piled up one over another, they are processed into a finished product by means of a device such as an autoclave.

By the way, the most conspicuous complex materials in recent years above all are such high-function fiber materials as the aforesaid carbon fiber, aromatic polyamide filament and ceramic fiber which are used for reinforcing a matrix such as a synthetic resin. Those high-function fiber materials are normally supplied in multi-filament status where plural filaments are bundled and adhered together with a sizing agent. In the event where such multi-filaments as mentioned above are put to use as supplemental fiber materials for reinforcing a matrix, it is necessary to structurally strengthen adhesion between each filament and said matrix by enlarging the contact area therebetween. In order to satisfy this requirement, it is effective to thinly spread those multi-filaments in sheetlike shape. In other words, a complex material can not play its effective and important role without being structured in such a manner that the surface of each filament attaches to and firmly clings to a matrix.

However, in fact, it is extremely difficult to uniformly impregnate the interval between adjoining filaments with a matrix especially in the event where a multi-filament is used as a supplemental fiber material for reinforcing said matrix. Thus, in order to solve the aforesaid issue, said multi-filament is thinly spread in sheetlike shape within a fixed width so that the interstices among the filaments are impregnated with a matrix such as a synthetic resin.

In this connection, a conventional way of flatly spreading a multi-filament is performed during the process where said multi-filament is released from a yarn supply section and goes on to be wound on a yarn winding cylinder. The following methods for that purpose are well-known among the concerned.

① A static method where static electricity is acted on a multi-filament on the move while a certain tension is imparted thereto in order to cause counteraction among individual filaments so as to spread the multi-filament.

② A pressing method where a multi-filament is pressed by revolving rollers so that it is flatly squeezed and smashed in spread shape.

③ A jetting method where a multi-filament is subjected to water or air jet so that it is flatly spread.

④ A ultrasound method where the sizing of adjoining filaments (e.g. by means of a sizing agent) is undone by giving ultrasound vibration to the multi-filament so as to flatly spread it.

It is the ideal state of a supplemental fiber material for reinforcing a matrix which is made of a multi-filament spread sheet that the filaments each continuously extend in straight manner without any yarn cut thereon so that they do not intermingle with one another and align in parallel to each other with maintaining a certain interval between adjoining filaments so as to be orderly disposed within a certain width.

However, any one of the aforesaid conventional methods is intended to set apart the filaments from one another so as to flatly spread them by acting such strong physical external forces as electrical counteraction, roller pressure, fluid impact and ultrasound vibration etc. on the multi-filament. Thus, in the event where the efficiency of the multi-filament spread operation is tried to improve, it is necessary to spurt strong air jet on the bundle of filaments by enhancing the air velocity especially in the case of adopting the prior jetting method.

In the event where the aforesaid external forces such as static electricity, rolling pressure, jet force and ultrasound vibration and so forth are intensified in order to enhance the efficiency of the multi-filament spread operation, a multi-filament spread sheet having such width and thinness as required can not be obtained while it unavoidably occurs that the filaments are subject to damage such as yarn cut and fluffing due to strong external forces acting on said filaments. As to such fibers vulnerable to break as carbon filament and ceramic fiber, they are damaged to the extent that they can not be put into a practical use any more.

In addition, with the aforesaid conventional ways of the multi-filament spread operation, the filaments are enforced to be separated from one another by said external forces, therefore, the filaments result in being complexly intermingled with one another so that such width and parallelism among filaments as required are difficult to obtain. Moreover, the static method as mentioned above can not be applied to such conductive fibers as carbon and metallic filaments.

Furthermore, it is normal that an untwisted multi-filament is used for the multi-filament spread operation in order to enhance its operational efficiency. Even though the multi-filament is seemingly in untwisted state seen from the whole bundle of filaments, there are some cases where the filaments are intermingled with one another partly within the bundle. The aforesaid conventional ways could not deal with those intermingled portions within the bundle of filaments. Some comments are given as follows to further explain this prior issue.

To explain in reference to FIG. 1, provided that a high-quality untwisted multi-filament which does not have such intermingled portions as mentioned above is put to use, when the multi-filament wound around a yarn supply section (1') at an angle ($\tau$) is released from a releasing point (o) on said section (1'), said multi-filament will return to the shortest distance line (l) connecting a releasing fulcrum (p) on said yarn supply section and a grip point (q) on a feeding roller so that such force ($\Delta$) as indicated with an arrow in the drawing works on the multi-filament. At this time, owing to the friction of the surface of the yarn supply section against an untwisted multi-filament ($F_1$), said multi-filament ($F_1$) revolves so that there partly occurs twist in the multi-filament. In other words, even though there should be no twist on the multi-filament ($F_1$) itself to be used, there posteriorly occur false twists in a part of said multi-filament when it is released from the yarn supply section so that parallelism among the spread filaments is interrupted. In this connection, the multi-filament ($F_1$) on the yarn supply section (1') has its winding direction alternatively changed in the opposite direction every winding layer so that the revolving direction of the multi-filament ($F_1$) alternatively changes too with the result that such false twists as an S twist and a Z twist alternatively occur on the multi-filament ($F_1$). There are some cases where such false twists as mentioned above occur at the production stage by a multi-filament spinning manufacturer, that is to say, even though the multi-filament is in untwisted state before the yarn winding operation, false twists occur on the multi-filament at this operation.

Furthermore, with the aforesaid conventional methods of the multi-filament spread operation, it is impossible to mix different types of multi-filaments with one another or to make either different or similar types of multi-filaments a pileup sheet by piling them up one over another synchronously with the spread operation or make either different or similar types of multi-filaments a wide spread sheet by spreading them in parallel to each other.

SUMMARY OF THE INVENTION

In view of the above-mentioned inconveniences encountered with the prior arts, the present invention is to provide a high-quality multi-filament spread sheet free from such prior issue as fluffs by spreading the filaments in such a manner that each filament continuously extends in straight manner without any yarn cut thereon so that the filaments are uniformly and orderly disposed in parallel to each other within a fixed density and width.

The present invention is also to provide an epoch-making method of efficiently mass-producing a multi-filament spread sheet from a ready-made multi-filament that is excellent in such characteristics as resin impregnation and filament alinement which are indispensable for a supplemental fiber material to be mixed with a matrix for reinforcement and an apparatus used in the same.

The present invention is also to provide a method of efficiently producing a multi-filament spread sheet of blend type from different types of multi-filaments by mixing plural multi-filaments with one another synchronously with the multi-filaments spread operation and an apparatus used in the same.

The present invention is also to provide a method of efficiently producing a multi-filament spread sheet of blend type from either different or similar multi-filaments by piling them up one over another synchronously with the multi-filaments spread operation and an apparatus used in the same.

The present invention is further to provide a method of producing a multi-filament spread sheet wide enough to satisfy the needs of the purchasers from either different or similar multi-filaments by spreading them in parallel to each other and an apparatus used in the same.

Other objects as well as the effects of the present invention are to be more clarified with the following description.

In order to solve the aforesaid inconveniences of the prior arts, the present inventors have adopted such method as while a multi-filament comprising plural filaments is supplied from a yarn supply section to a yarn winding section by means of a feeding control mechanism so that the overfeed of said multi-filament occurs to some extent, air blows crosswise with a moving multi:filament so that said multi-filament archly bends downwards so as to unforcedly spread breadthwise widthwise and transform into a multi-filament spread sheet. The most characteristic point of this method lies in the skillful incorporation of fluid dynamics into the multi-filament spread operation.

The present inventors have also adopted an apparatus wherein a suction cavity of a certain breadth is arranged below the moving course of the multi-filament through which the multi-filament oversupplied by a fixed amount flows between a yarn supply section and a yarn winding section so that a moving multi-filament over the suction cavity is subjected to continuous air so as to be archly bent and spread widthwise. The most characteristic point of this apparatus lies in that the multi-filament on the move is archly bent by continuous air so as to be spread widthwise.

To further give some comments on the aforesaid means to solve the prior issues, the definition of a multi-filament referred in the present invention is as follows. It is the collective body of the plural number of long and continuous filaments such as synthetic fiber, carbon fiber, ceramic fiber and metallic fiber, including tow in bundle status.

The present invention is intended to archly bend a multi-filament oversupplied by a fixed amount by subjecting the multi-filament to air so as to make said multi-filament spread in sheetlike shape. In this case, the longer the bending section of the multi-filament as well as the larger the crossing region of air with said bending section become, the better the multi-filament spread operation results. However, actually, if the bending section of the multi-filament becomes longer, the sinking of said bending section necessarily becomes larger due to gravity acting thereon while there is technological setback and economic restraint to the means to generate such air as uniformly blowing throughout such long bending section of the multi-filament with a fixed velocity. Therefore, it restricts the length of said bending section and the crossing region of air with this section. Besides, if the filaments extend too much, it practically damages the spreading uniformity among the filaments.

Thus, it is preferably embodied in the present invention that plural bending sections formed on the multi-filament are respectively subjected to air blowing crosswise therewith several times or the sizing of filaments are loosened by such unharmful external forces as slight compression by means of pressing rollers and light ultrasound vibration before said bending sections are subjected to air blowing crosswise with the multi-filament so as to preliminarily spread the filaments widthwise. In this way, not only the efficiency of spreading the multi-filament by means of air further improves, but also the prior issue where such false twists as an S twist and a Z twist are unavoidably and alternatively generated partly on the multi-filament when the multi-filament is released from the yarn supply section because of the alternative change of the winding direction of the multi-filament on the yarn supply section is advantageously solved in such a manner that an S twist and the subsequent Z twist sequentially set against each other by tensile force working between the preliminarily extended region and the air spread region of the multi-filament.

In the present invention, such operation is performed on the multi-filament to be oversupplied by a fixed amount from the yarn supply section to the yarn winding section as archly bending said multi-filament by means of air blowing crosswise with said multi-filament. Said air to be acted thereon is preferably of suction air where the less turbulence and whirling flow it has, the better it is.

The principal point of the present invention lies in that a multi-filament spread sheet is produced by setting apart the filaments widthwise in such a manner that air is blown over the multi-filament oversupplied by a fixed amount. However, it is also possible that a complex multi-filament spread sheet made of different types of multi-filaments is produced by synchronously performing the aforesaid operation on plural multi-filament spread sheets respectively and either disposing those sheets in plane shape or piling them up one over another and then subjecting the bending section of the complex multi-filament sheet on the process to the suction air. In this way, complex multi-filament spread sheets of blend type can be produced where arbitrarily selected types of multi-filament spread sheets are piled up one over another or the fringe sides of those spread sheets are widthwise combined together as well as those spread sheets are piled up one over another in either an orderly or stepwise multilayered status. There occurs neither fluff nor yarn cut on the filaments of the aforesaid complex sheets so that it can obtain a multi-filament sheet product which is free from damage and the filaments of which are orderly disposed in parallel to each other.

BRIEF DESCRIPTION OF THE DRAWINGS

FIG. 25 at (2) is a perspective view of a complex multi-filament spread sheet produced by overlapping the fringe sides of those spread sheets one over another.

FIGS. 32 and 33 are tables to comparatively show the measured result on the effectiveness of the multi-filament spread operation by means of the apparatus in the third embodiment and the prior spreading method respectively.

DESCRIPTION OF THE PREFERRED EMBODIMENT (First Embodiment)

Figure 2:
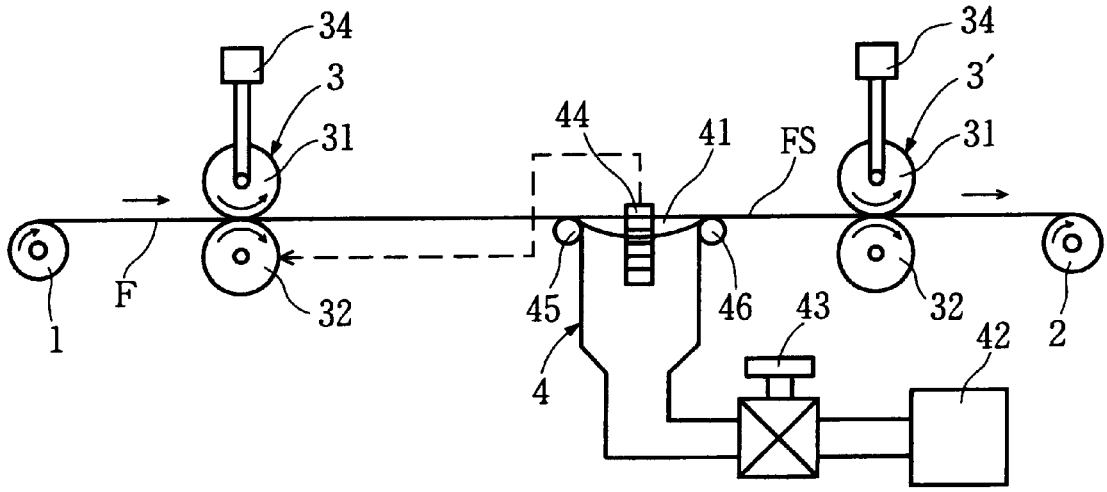
FIG. 2 is a schematic side view of an apparatus disclosed in the first embodiment of the present invention.
Figure 3:
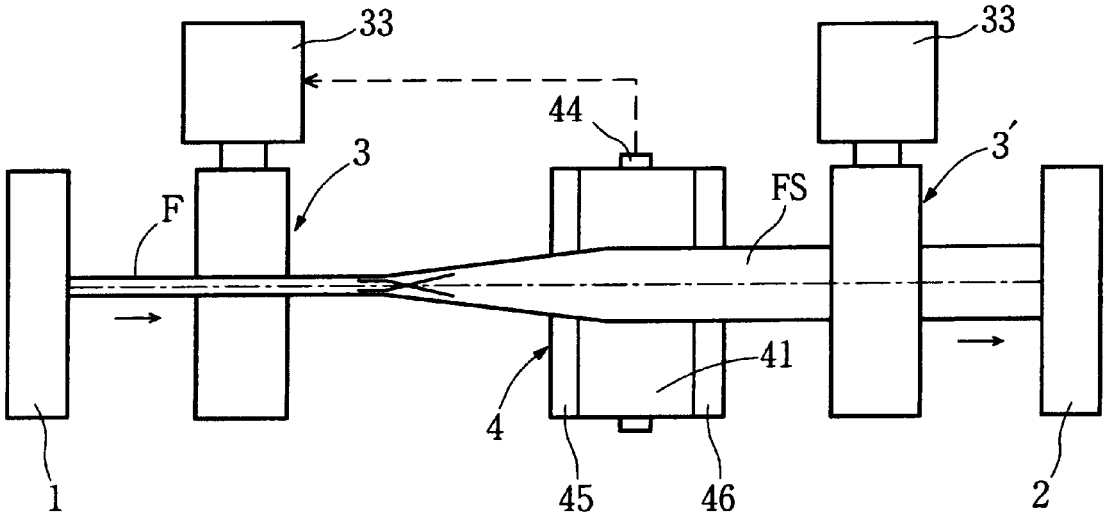
FIG. 3 is a plan view of the apparatus disclosed in the first embodiment.

The method and apparatus in the first embodiment of the present invention are concretely shown in FIGS. 2 and 3.

Namely, in the present embodiment, it is intended that in the process where a multi-filament (F) (untwisted carbon fiber whose original width and thickness are 6 mm and 0.1 mm respectively comprising 12,000 filaments each having 7 μm in diameter) is supplied from a yarn supply section (1) to a yarn winding section (2), the filaments are spread from one another widthwise so as to produce a multi-filament spread sheet.

The multi-filament (F) supplied from the yarn supply section (1) after released therefrom is fed into a suction cavity (4) provided between a front feeder (3) and a rear feeder (3') while said multi-filament is subjected to feeding speed control by said feeders (3) and (3') so that it is oversupplied by a fixed amount. Then, said multi-filament (F) moving above the suction cavity (4) is drawn into an aperture (41) of the suction cavity so as to be archly bent by suction air (air velocity: 50 m/sec.) blowing into the aperture (41). Because of the bending force acting on the multi-filament (F) by air, it causes the filaments to be disengaged from one another so that the unity of the filaments fluctuates. Then, suction air blowing crosswise (in the present embodiment, from above to below) with the multi-filament (F) in fluctuation depressurizes both sides of the multi-filament (F) as proved by Bernoulli's theorem so as to cause the multi-filament to extend widthwise. In this way, the multi-filament (F) the engagement of whose filaments is loosened by means of the aforesaid bending operation is set apart from one another breadthwise widthwise when it passes over the aperture (44) of the suction cavity (4) and transformed into a thin multi-filament spread (FS) sheet of approximately 12 mm in width and 0.07 mm in thickness.

Then, the apparatus for producing a multi-filament spread sheet in the first embodiment is described as follows.

Namely, the yarn supply section (1) as well as the yarn winding section (2) of the apparatus as schematically shown in FIGS. 2 and 3 are of the conventional prior arts.

Figure 4:
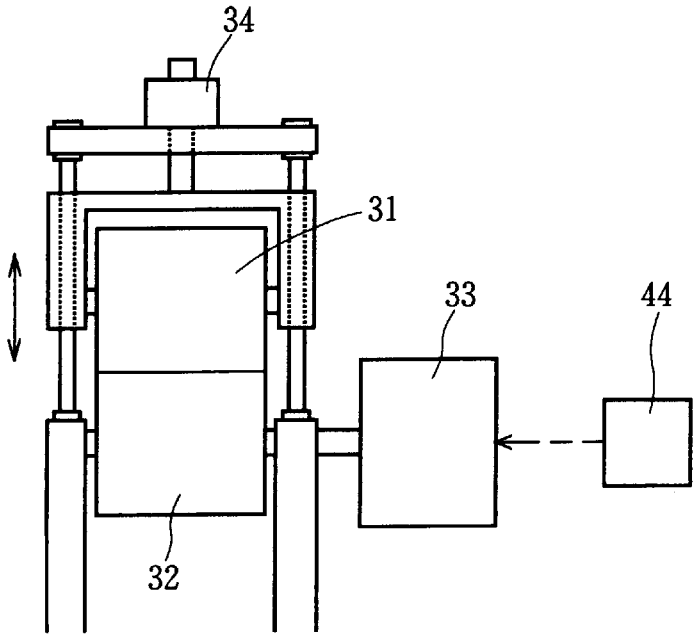
FIG. 4 is an enlarged elevation view of the feeding mechanism of the apparatus in the first embodiment as seen from the moving direction of the multi-filament.
Figure 5:
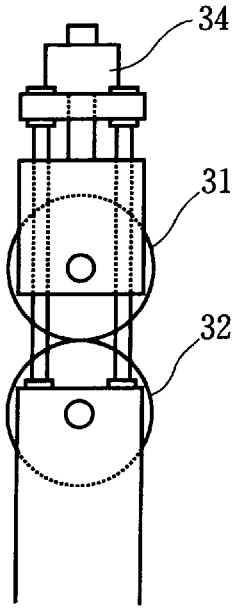
FIG. 5 is an enlarged side view of the feeding mechanism of the apparatus in the first embodiment.

Then, either of the aforesaid front feeder (3) and rear feeder (3') is intended to feed the multi-filament (F) by interposing the multi-filament (F) between a top roller (31) and a bottom roller (32). The feeding speed of the multi-filament can be controlled by a servo motor (33) connected to the revolving shaft of the bottom roller (32) (refer to FIG. 4). This servo motor (33) responds to the control signal output by a bending sensor provided on the suction cavity (4) in order to control the feeding speed of the multi-filament so that it is oversupplied by a fixed amount between the feeders (3) and (3'). The standard feeding speed of said front feeder (3) is set at 10 m/min., but it is controlled by the control signal output by a bending sensor as described below so that the multi-filament is always overfed by 10 cm while the feeding speed of the rear feeder(3') is fixed at 10 m/minute. On the other hand, the squeezing pressure by the top roller (31) and the bottom roller (32) of the front and rear feeders (3) and (3') on the multi-filament can be where appropriate adjusted by means of an air cylinder (34) to adjust the elevation of the revolving shaft of the top roller (31) thereof (refer to FIGS. 4 and 5).

Said suction cavity (4) is opposedly arranged below the moving course of the multi-filament (F) between the front and rear feeders (3) and (3'), and the aperture (41) of said cavity (4) is opened to the upper side thereof so that it receives a portion of a moving multi-filament CF). This suction cavity (4) generates uniform suction air towards the feeding course through which the multi-filament (F) is supplied by driving a vacuum pump (42) connected to said cavity (4). The suction air acting on the multi-filament (F) can be adjusted where appropriate by an air adjusting valve (43) provided between said suction cavity (4) and vacuum pump (42). Then, a CCD line sensor of light emitting and receiving type is provided on the suction cavity (4) as a bending sensor (44) in such a manner that it may interpose the feeding course of the multi-filament (F) at both sides. The sensor (44) constantly measures the bending amount of the multi-filament (F) passing through said suction cavity (4) on a full-time basis and sends a control signal corresponding to the measured value to the servo motor (33) of the front feeder (3) and controls the revolving speed of the roller so that a fixed bending amount of the multi-filament can be maintained. An entrance guide roller (45) is provided on the upstream side of said suction cavity (4) while on the downstream side thereof an exit guide roller (46) is provided so as to smoothly introduce and send off the multi-filament (F).

(Second Embodiment)

Figure 6:
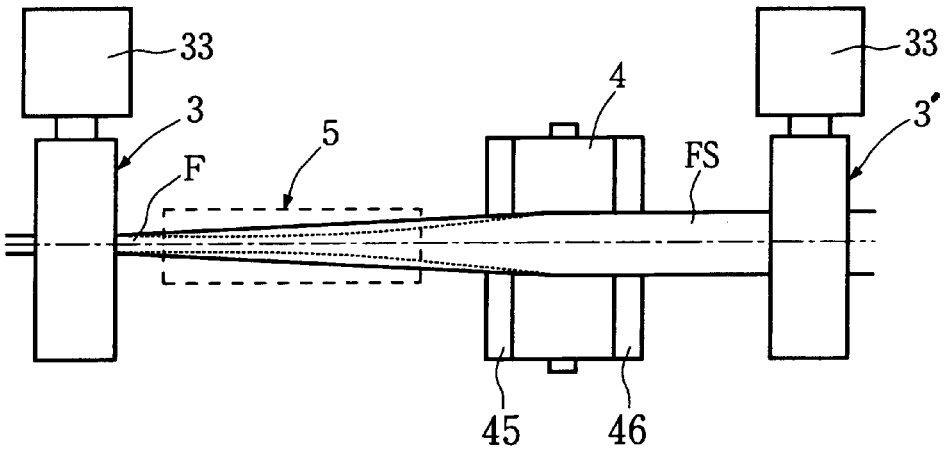
FIG. 6 is a schematic side view of an apparatus disclosed in the second embodiment.
Figure 7:
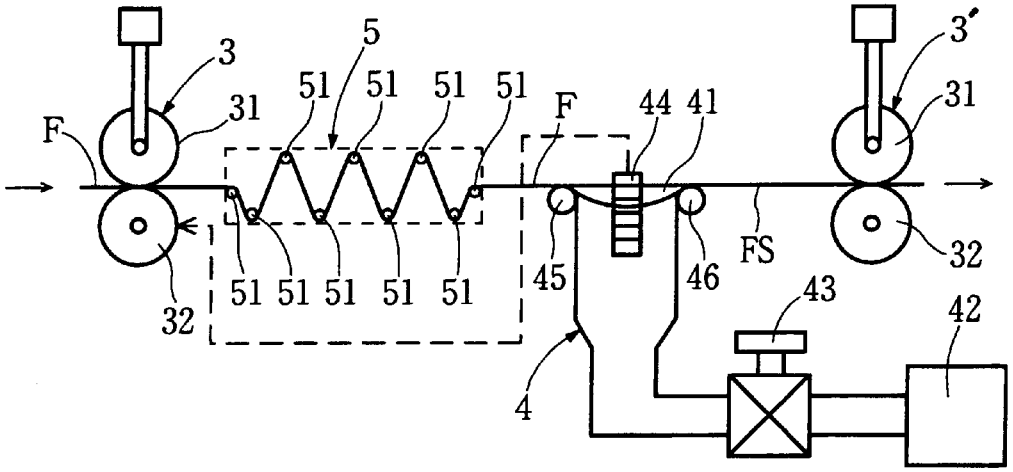
FIG. 7 is a plan view of the apparatus disclosed in the second embodiment.

The method and apparatus in the second embodiment of the present invention are shown in FIGS. 6 and 7.

The difference between the first embodiment and the second one lies in that a preliminary extension mechanism (5) intervenes between the front feeder (3) and the suction cavity (4). In this embodiment, a series of rollers (51).(51) . . . that are disposed zigzag are adopted as a preliminary extension mechanism (5). In the process where a multi-filament (F) (untwisted carbon fiber whose original width and thickness are approximately 6 mm and 0.1 mm respectively comprising 12,000 filaments each having 7 m in diameter) contacts this series of rollers (51).(51) . . . by a fixed tensile force and advances while alternatively contacting lower rollers (51) and upper rollers (51), the filaments stuck together by a sizing agent are getting softly disengaged as if it was manually handled so as to be flatly extended broadwise into a work-in-process having about 10 mm in width and about 0.08 mm in thickness.

The multi-filament (F) preliminarily extended this way is then subjected to the feeding speed control by the front and rear feeders (3) and (3') so that it is overfed with a fixed amount and then carried over to the suction cavity (4). Said multi-filament (F) moving over this suction cavity (4) is drawn into the aperture (41) of the suction cavity (4) by the suction air of 50 m/sec. blowing at said aperture (41) so as to be archly bent. Thereby, the engagement among the filaments composing the multi-filament (F) is further loosened and the interstice between adjoining filaments is further enlarged.

The suction air to pass through the multi-filament (F) and depressurize both sides thereof enhances the effectiveness of spreading the multi-filament (F) the engagement of whose filaments is loosened beforehand by the aforesaid preliminary extension mechanism (5). In this way, an extremely thin, but wider multi-filament spread sheet (FS) can be obtained whose width is about 18 mm and thickness is about 0.05 mm on the average.

Aerodynamical Explanation of the First and the Second Embodiments

Next, the aerodynamical explanation of the aforesaid first and second embodiments is described below where the multi-filament (F) is spread in sheetlike shape at the aperture (41) of the suction cavity (4) by air.

FIGS. 8 to 11 are notional illustrations of the multi-filament in air stream and the circles in the drawings each show one filament.

Figure 8:
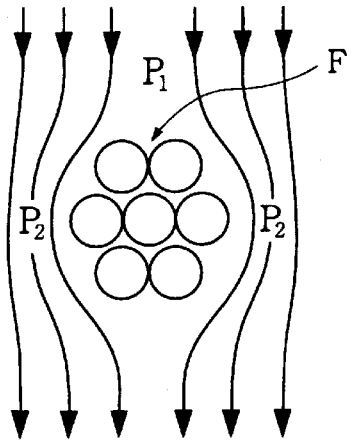
FIGS. 8 to 10 are illustrations to aerodynamically explain the theory of the multi-filament spread operation embodied in the present invention.

Firstly, FIG. 8 shows the state where a virgin multi-filament (F) whose filaments have not yet been disengaged from one another is exposed to air. When air encounters said multi-filament (F) for the first time, it flows into both sides of the multi-filament (F). In this state, the air velocity right above the multi-filament (F) is substantially equal to zero.

In this case, the potential energy can be disregarded so that Bernoulli's formula can be modified as $\frac{1}{2}\rho\omega^2+P=$ constant. The variable "ρ" indicates fluid density and the indicates air velocity while the "P" indicates pressure.

Based on the aforesaid Bernoill's formula, the correlation between the pressure ($P_1$) right above the multi-filament (F) and the pressure $P_2$ on both sides of the multi-filament (F) becomes $P_1>P_2$ so that widthwise thrust works on the filaments located in both sides of the multi-filament (F).

Figure 9:
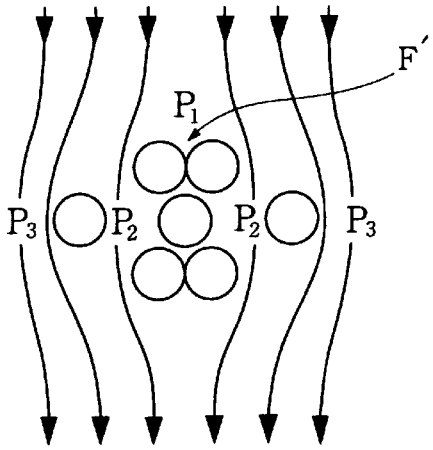

FIG. 9 shows the advanced state where the engagement among the filaments is further loosened. When air encounters the multi-filament (F) in this advanced state, it collides on the very top of the multi-filament (F) so as to separate into both sides of the multi-filament (F), but at this time air also blows into the interstices between the filaments located on both sides of the multi-filament whose engagement has been loosened and the clod of filaments on the center thereof. In this case, the correlation among the pressure ($P_1$) acting on the clod of filaments on the center, the pressure ($P_2$) acting on the interstices between the clod of filaments on the center and the filaments located outermost from the center and the pressure ($P_3$) acting on the outer side of the filaments located outermost from the center becomes $P_1>P_2>P_3$ so that thrust towards the interstices works on the filaments in the clod located nearer to said interstices and far greater outward thrust works on the filaments located outermost from the center.

Figure 10:
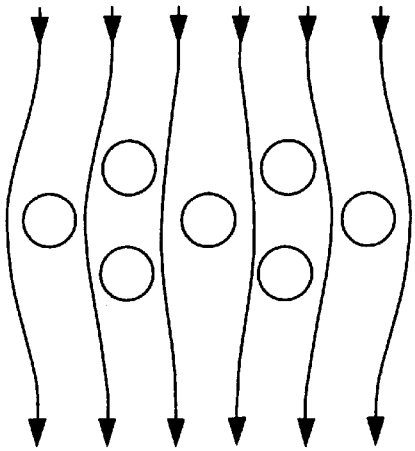

FIG. 10 shows the state where the spreading condition of the multi-filament has gone stable. This state can be realized when air blows through the interstices generated among the filaments of the multi-filament (F).

Figure 11:
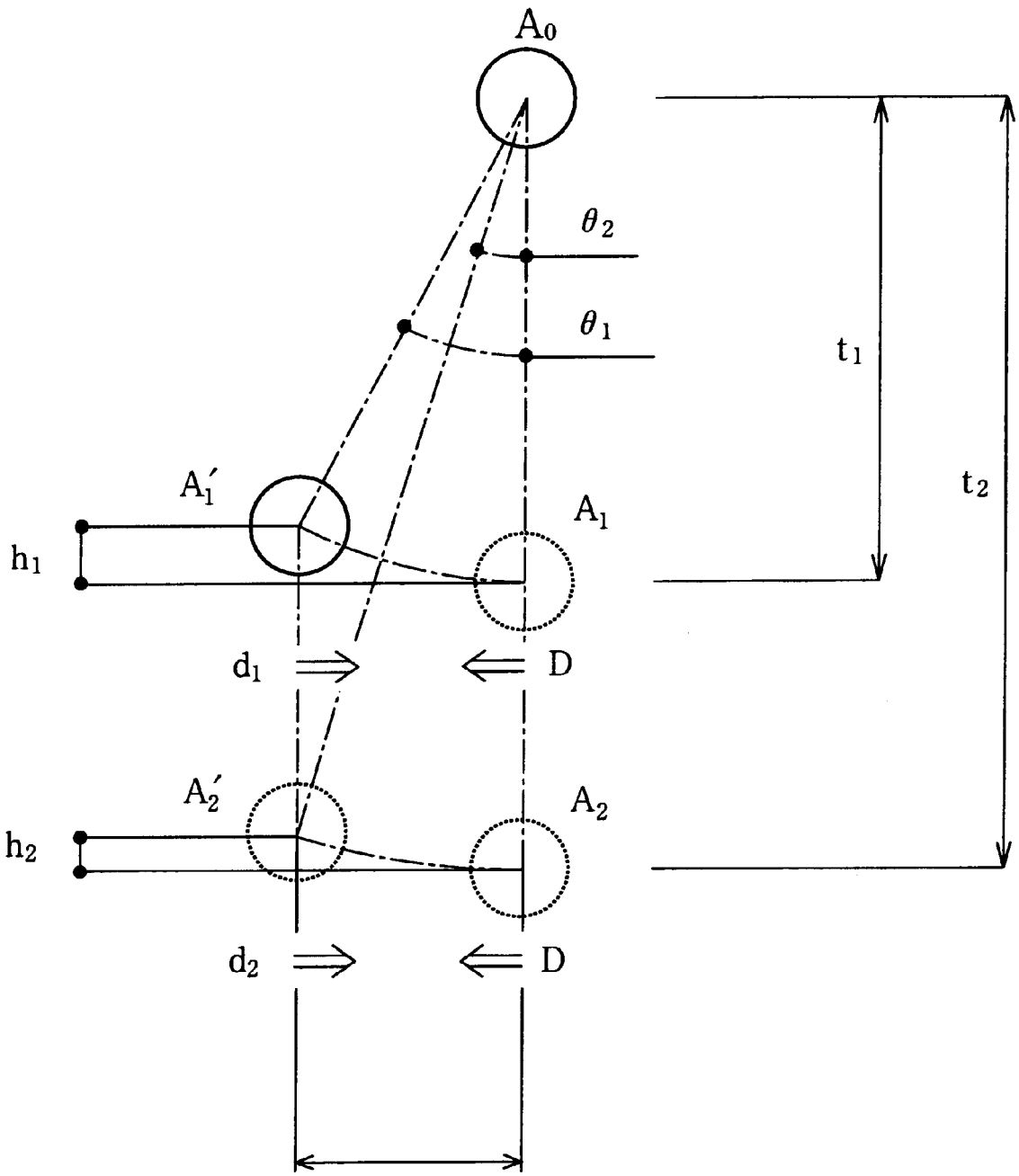
FIG. 11 is an illustration to aerodynamically explain that a bending portion of the multi-filament is subjected to suction air so as to set apart the filaments.

FIG. 11 by taking as examples the filaments ($A_1$) and ($A_2$) of the multi-filament archly bent in the suction cavity (4) illustrates the state where both of those filaments moved outwards so as to spread widthwise by dint of suction air.

When the filaments ($A_1$) and ($A_2$) are given bending amount ($T_1$) and ($T_2$) respectively at the suction cavity (4), those filaments can freely move anywhere within the circles the radii of which are ($T_1$) and ($T_2$ ) taking a point ($A_0$) as the center. However, in the present invention, because air acting on those filaments causes those filaments to move outwards as well as to the downstream side of air flow, they are restricted to move on the circumference of the circles the radii of which are ($T_1$) and ($T_2$ ) taking a point ($A_0$) as the center.

Because the filaments ($A_1$) and ($A_2$ ) having moved on the circumference of the circles are positioned higher by ($h_1$) and ($h_2$) respectively than the original positions, they have potential energy so that they will return to the original positions. Also because the outward movement of those filaments is centered on the point ($A_0$), it causes them to be twisted so that they will return to the original positions. Namely, composite force ($d_1$) and ($d_2$) each comprising both said potential energy and restoring force work on those filaments ($A_1$) and ($A_2$ ) respectively to energize them so that they will return to the original positions. Then, those filaments move to the positions where the force by suction air to cause those filaments to move outwards as well as to the downstream side of air flow and said composite force ($d_1$) and ($d_2$) to cause those filaments ($A_1$) and ($A_2$ ) to return to the original positions are equilibrated so as to maintain the balance of power.

Figure 12:
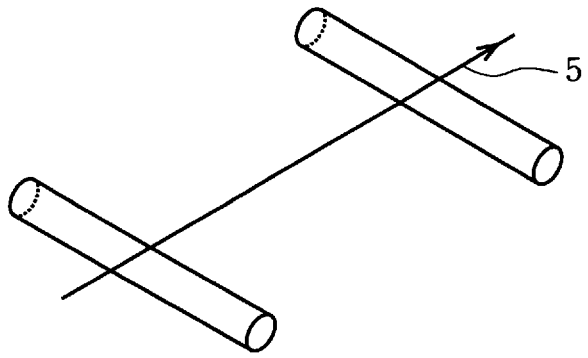
FIGS. 12 to 15 are illustrations to explain the theory of the multi-filament spread operation embodied in the present invention from a different point of view.
Figure 13:
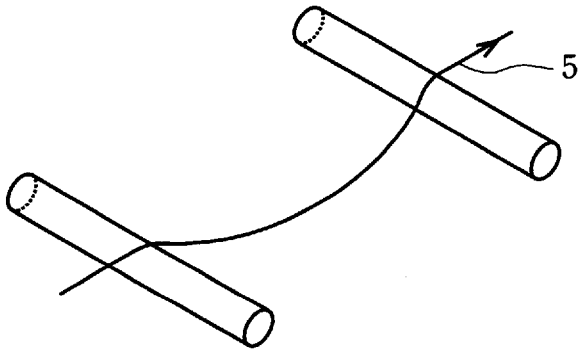
Figure 14:
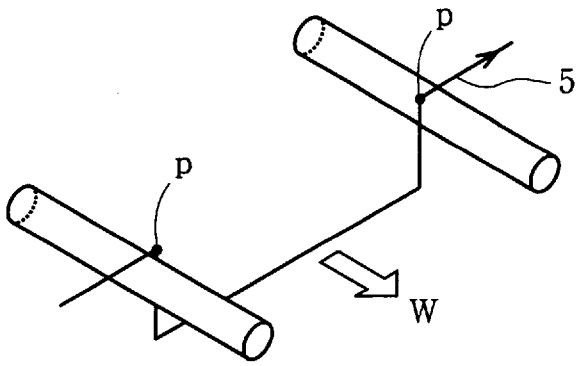
Figure 15:
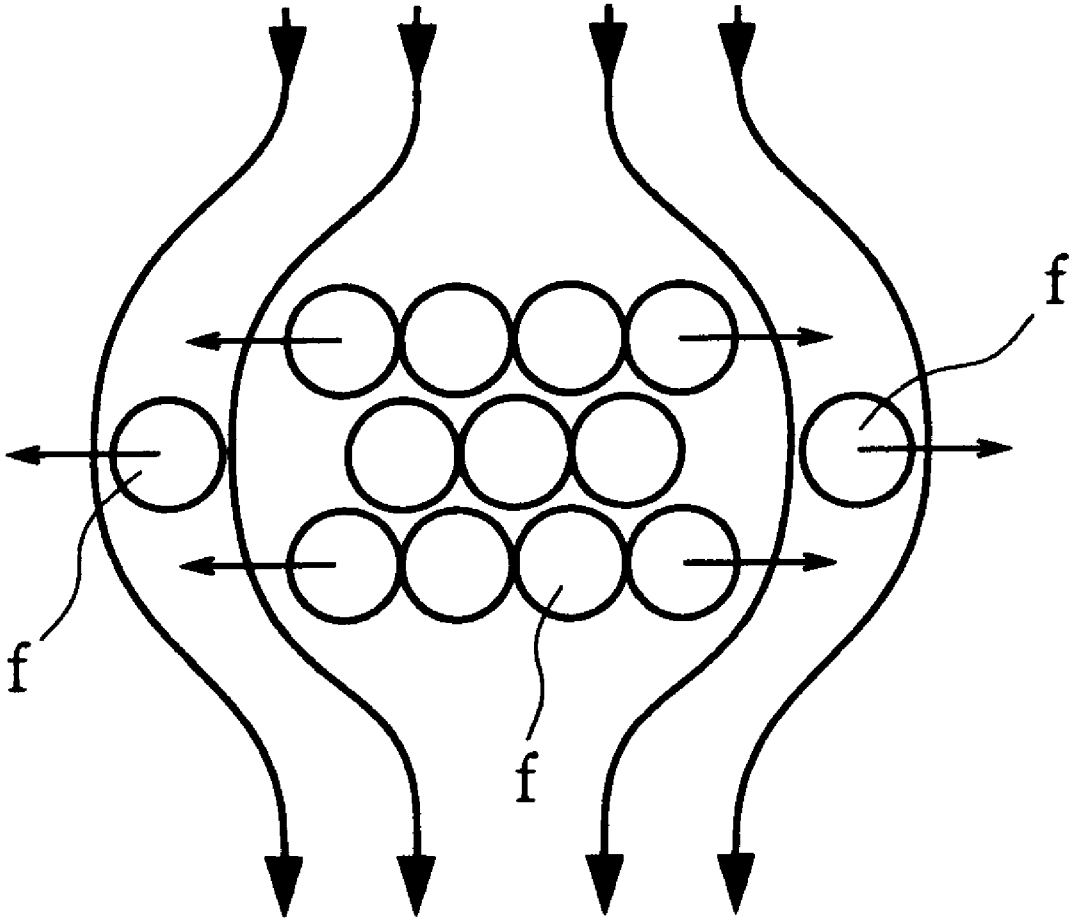

In other words, the larger the bending amount of the filament becomes, the less suction air is required to spread the multi-filament in the same horizontal distance as the filament moves (widthwise) with smaller bending amount because of less potential energy and restoring power working on the filament. Considering this point by paying attention to one single filament (f) of all the components of the multi-filament, and assuming that this filament (f) is in linear shape as shown in FIG. 12 and it is intended that this filament is moved breadthwise (widthwise) by dint of air, it requires considerably large quantity of air. However, if this filament (f) is bent a little as shown in FIG. 13, it becomes possible to move it by small quantity of air. That is to say, the reason the filament comes to easily move breadthwise (widthwise) is attributable to the action of crank shape formed on the filament. Bending the filament (f) as shown in FIG. 14 is the same concept as forming each filament of the multi-filament in crank shape. By forming the filament in crank shape, the filament (f) oscillates by minute external force (W) taking points (p) and (p) as fulcra due to leverage. In this way, the filaments (f).(f) . . . of the multi-filament disengage from one another so as to spread breadthwise (widthwise) (refer to FIG. 15).

(Third Embodiment)

Figure 16:
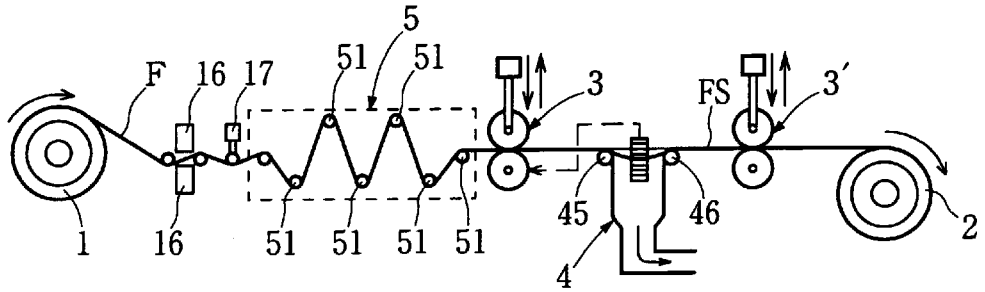
FIG. 16 is a schematic side view of an apparatus embodied in the third embodiment of the present invention.
Figure 17:
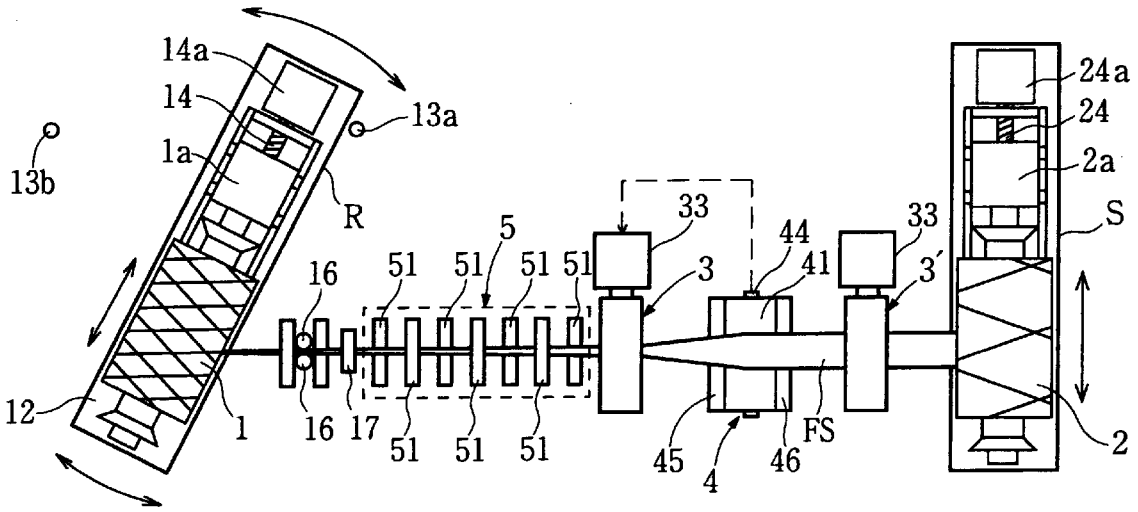
FIG. 17 is a plan view of the apparatus of the third embodiment of the present invention.

The method and apparatus in the third embodiment of the present invention are shown in FIGS. 16 and 17.

The difference between the second embodiment and this one lies in that a yarn supply unit (R) carrying a yarn supply section (1) is rotatably controlled so that the winding direction of a multi-filament immediately before being released from the yarn supply section (1) aligns the moving direction of the multi-filament (F) after being released from said supply section (1) as well as said supply section (1) is controlled so that it can go back and forth on the yarn supply unit (R).

Figure 18:
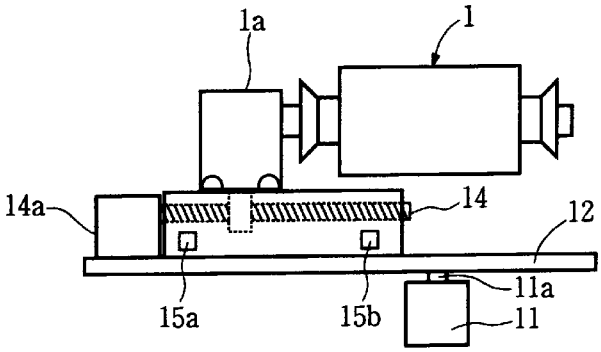
FIG. 18 is an elevation view of a yarn supply unit of the apparatus of the third embodiment as seen from the feeding direction of the multi-filament.
Figure 19:
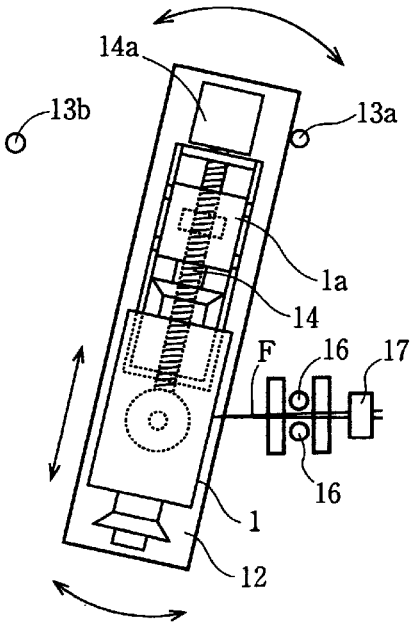
FIG. 19 is a plan view of the yarn supply unit of the apparatus in the third embodiment.
Figure 20:
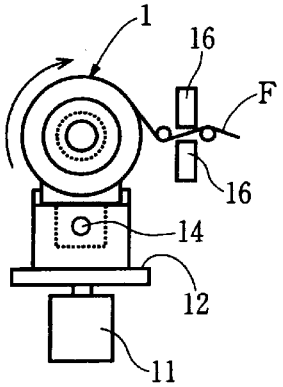
FIG. 20 is a side view of the yarn supply unit of the apparatus in the third embodiment.

That is to say, the yarn supply unit (R) of the apparatus in the third embodiment of the present invention comprises a bed (12) reciprocally rotatably supported on a revolving shaft **(11*a*) of a servo motor (11); touch sensors (13*a*) and (13*b*) controlling the reciprocal revolving stroke of the bed (12); a ball screw (14) arranged on said bed (12) to make the whole yarn supply section (1) move back and forth by means of reversible rotation of a servo motor (14*a*); stroke sensors (15*a*) and (15*b*) controlling the back-and-forth movement of the ball screw (14); a released yarn position detector (16) to detect the position of the mulitifilament (F) released from the yarn supply section (1) whose back-and-forth movement is given by the driving of the ball screw (14); and a released yarn tension sensor (17) to measure and detect the tensile force of the multi-filament (F) to be released from the yarn supply section (1) and send a control signal to a brake motor (1*a*) which rotatively drives the yarn supply section (1) so as to adjust the tensile force of the multi-filament (F) to be released therefrom (refer to FIGS. 18 to 20**).

Then, a position signal output by said released yarn position detector (16) is sent to the servo motor **(14*a*) of the ball screw (14) so as to reversibly rotate the servo motor (14*a*) and move back and forth the yarn supply section (1) so that the releasing position of the mulitifilament (F) aligns the moving course thereof while a revolving direction command signal is output from said touch sensors (13*a*) and (13*b*) to restrictively control the reciprocal revolution of the bed (12) and a yarn supply section moving command signal is output from stroke sensors (15*a*) and (15*b*) to restrictively control the back-and-forth movement of the yarn supply section (1). In this case, because the number of wound layers of the multi-filament (F) on the yarn supply section (1), the winding angle as well as the number of wound yarns of each layer, the winding breadth of each wound layer, and the tension coefficient of the multi-filament (F) which changes according as the winding diameter decreases are given conditions depending on the types of multi-filaments, by setting those conditions beforehand at the beginning of the operation, the winding direction of the multi-filament immediately before being released from the yarn supply section (1**) of the yarn supply unit (R) always aligns the moving course thereof.

Figure 1:
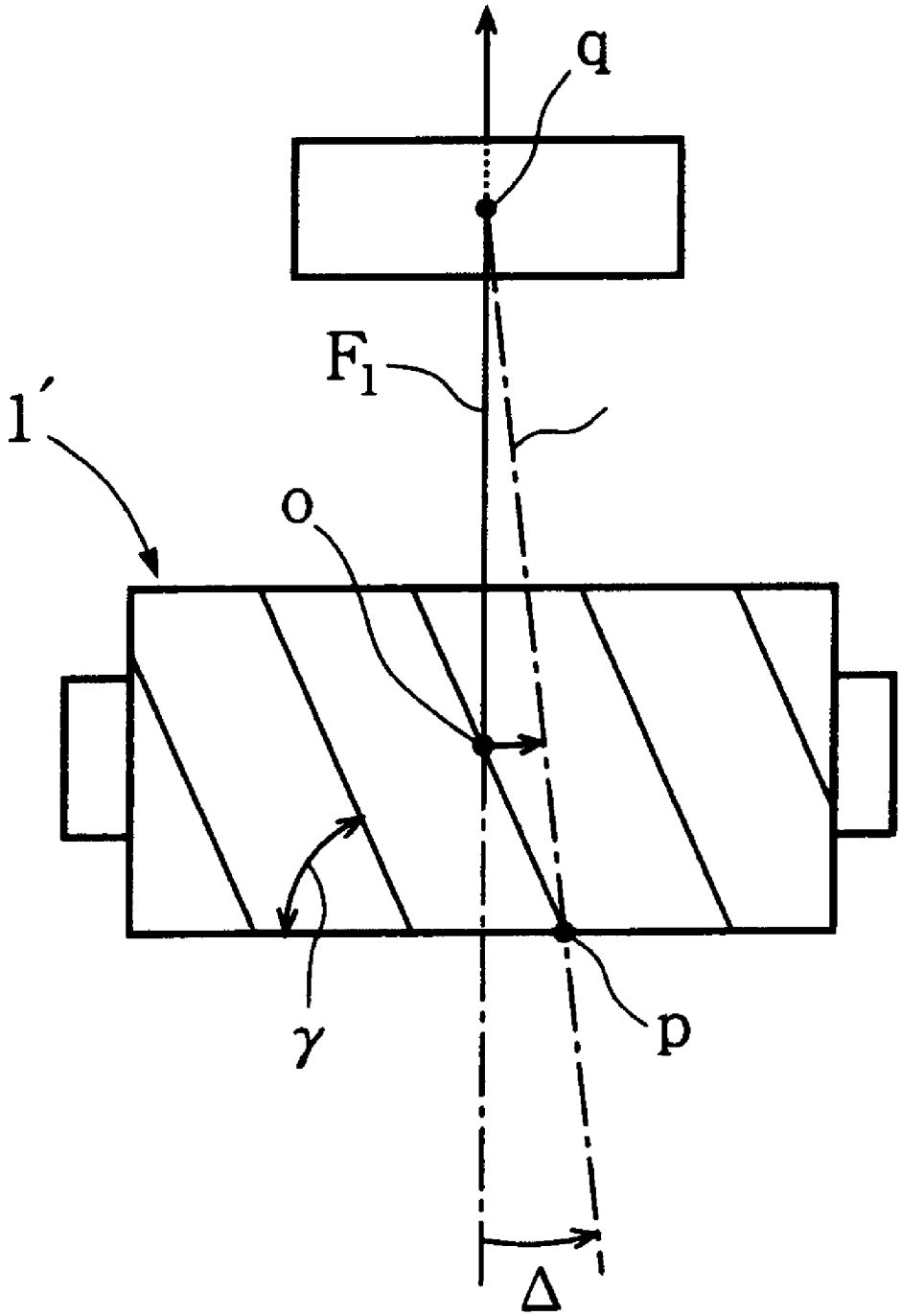
FIG. 1 is an explanatory view to show the cause of such false twists as an S twist and a Z twist on the yarn supply section occurring when the multi-filament is released from said section.

With the yarn supply unit (R) in the third embodiment of the present invention, it enables the winding direction of the multi-filament (F) immediately before being released from the yarn supply section (1) carried on the unit (R) to align the moving course of the multi-filament to be supplied. By adopting such yarn supply unit (R) as mentioned above, it can solve the prior issue where the rolling (Δ) of the multi-filament to subsequently invite false twists unavoidably occurs on the surface of the yarn supply section (1') as shown in FIG. 1.

Then, the multi-filament (F) released from the yarn supply section (1) of the yarn supply unit (R) is softly loosened and disengaged into the filaments by way of a series of rollers (51).(51) . . . of the preliminary extension mechanism (5) so as to be preliminarily extended in flat shape and is then transformed into a wide multi-filament spread sheet (FS) in extremely thin status whose filaments are orderly disposed in parallel to each other by way of the suction cavity (4) or subject to the same synergistic effect between the bending and aerodynamic operation performed on the preliminarily extended multi-filament as mentioned in the second embodiment so as to be wound into the yarn winding section (2). The yarn winding section (2) in the present embodiment is carried on a winding stand (S) so that it can move back and forth on said stand with a certain time span by means of a ball screw (24) to be reversibly rotated with a servo motor (24*a*) while the winding operation is carried out by a servo motor (2*a*).

(Fourth Embodiment)

Figure 21:
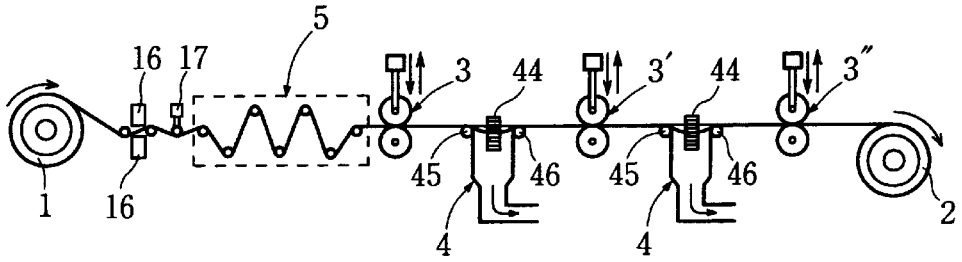
FIG. 21 is a schematic view of an apparatus in the fourth embodiment.
Figure 22:
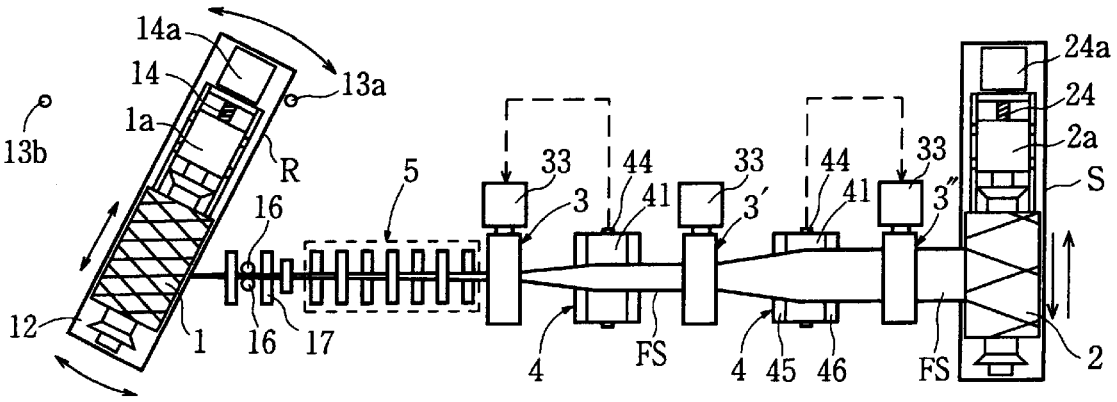
FIG. 22 is a plan view of the apparatus disclosed in the fourth embodiment.

The method and apparatus in the fourth embodiment of the present invention are shown in FIGS. 21 and 22.

The difference between the present embodiment and the third one lies in that a front feeder (3), a center feeder(3') and a rear feeder (3") are arranged between a preliminary extension mechanism (5) and a yarn winding section (2) and suction cavities (4) in two stages are arranged firstly between the front and center feeders (3) and(3') and secondly between the center and rear feeders(3') and (3') while a bending detector (44) of the first suction cavity (4) controls the front feeder (3) and that of the second suction cavity (4) controls the rear feeder (3").

With the apparatus in the present embodiment as shown in FIGS. 21 and 22, after the multi-filament (F) released and fed from a yarn supply section (1) is softly disengaged in such a manner that the engagement of the filaments are loosened enough to be extended breadthwise (widthwise) in flat shape by the preliminary extension mechanism (5), the preliminarily extended multi-filament is then subject to the synergistic effect between the bending and aerodynamic operation to be performed twice thereon at suction cavities in two stages so that a far wider multi-filament spread sheet (FS) in thinner status than that of the third embodiment can be obtained with the orderly disposition of the filaments in parallel to each other duly maintained.

(Fifth Embodiment)

Figure 23:
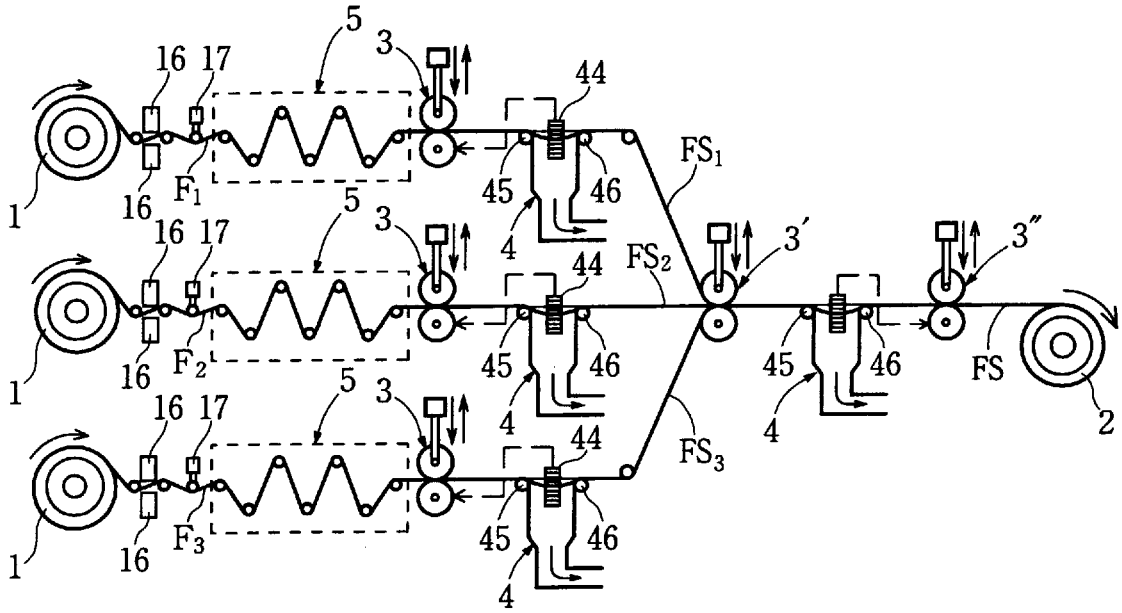
FIG. 23 is a schematic view of an apparatus in the fifth embodiment.

The method and apparatus in the fifth embodiment of the present invention are shown in FIG. 23.

This embodiment is intended to obtain a complex multi-filament spread sheet by vertically disposing the apparatus of the third embodiment as shown in FIG. 12 in three stages and piling up three multi-filament sheets supplied in as many stages one over another after the first suction cavity operation in each stage and further performing the second suction cavity operation on the pileup mulitifilament sheet.

That is to say, with the apparatus in the present embodiment, after each mulitifilament ($F_1$), ($F_2$) and ($F_3$) released and supplied from the upper, the middle and the lower yarn supply sections (1), (1) and (1) respectively is softly disengaged in such a manner that the engagement of the filaments are loosened enough to be extended breadthwise (widthwise) in flat shape by the preliminary extension mechanisms (5), (5) and (5), each preliminarily extended multi-filament is then subjected to the synergistic effect between the bending and aerodynamic operation by means of suction cavities (4), (4) and (4) so as to be transformed into thinly wide multi-filament spread sheets ($FS_1$), ($FS_2$) and ($FS_3$). Then, those sheets ($FS_1$), ($FS_2$) and ($FS_3$) are piled up one over another at the center feeder (3') and are sent to the second suction cavity (4) with the feeding speed of the pileup multi-filament spread sheet controlled so that it is oversupplied by a fixed quantity. The pileup multi-filament spread sheet comprising ($FS_1$), ($FS_2$) and ($FS_2$) encounters suction air at the second cavity (4) so as to archly bend to the downstream side of air flow and spread broadwise (widthwise) by the synergistic effect between the bending and aerodynamic operation to be further performed on the pileup sheet. At this time, the filaments of each multi-filament spread sheet ($FS_1$), ($FS_2$) and ($FS_3$) are orderly disposed in parallel to each other so as to be mixed into one complex multi-filament spread sheet.

According to the present embodiment, by selecting the type of multi-filament, it becomes possible to produce the variety of multi-filament sheets with various characteristics.

Figure 24:
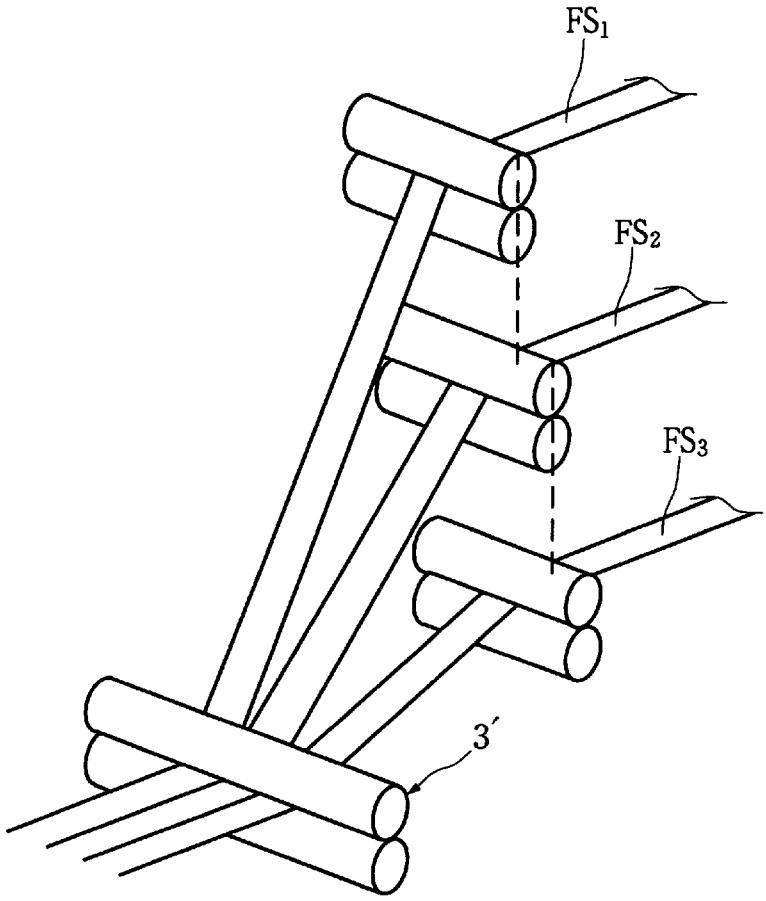
FIG. 24 is a perspective view showing the state where plural multi-filament spread sheets to be supplied in multistage manner are widthwise shifted a bit from one another in such a manner that the fringe sides thereof are overlapped one over another so as to mix those spread sheet into a complex multi-filament spread sheet.
Figure 25:
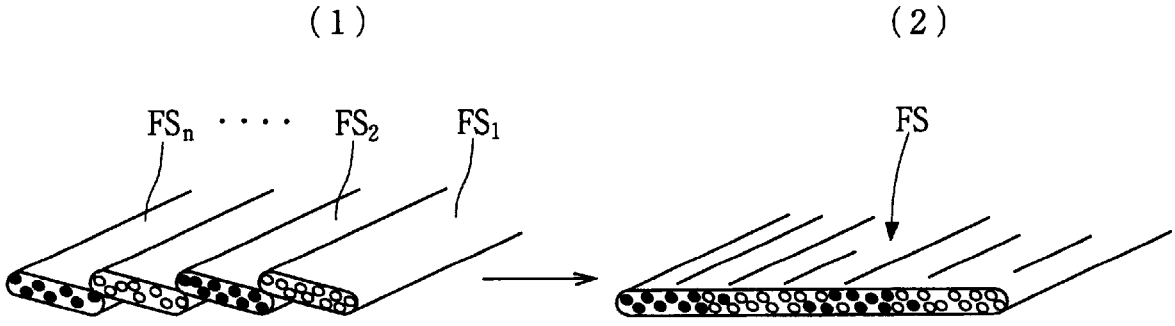
FIG. 25 at (1) is a perspective view to show the state where the fringe sides of plural multi-filament spread sheets are overlapped one over another.

For instance, the multi-filaments ($F_1$), ($F_2$) and ($F_3$) in the upper, the middle and the lower feeding stages respectively of the apparatus in the present embodiment are each transformed into multi-filament spread sheets ($FS_1$), ($FS_2$) and ($FS_3$) by way of the preliminary extension mechanisms (5), (5) and (5) in each stage and then the first suction cavities (4), (4) and (4) as mentioned above, but provided that those feeding stages are shifted widthwise a little from one another as shown in FIG. 24, the overlapped portions of the multi-filament spread sheets ($FS_1$), ($FS_2$) and ($FS_3$) are mixed into an integral body at the second suction cavity (4). Therefore, according to the selection of the type of multi-filament, it becomes possible to obtain a special type of complex multi-filament spread sheet where each property of various kinds of multi-filaments is mixed together (refer to FIG. 25).

Figure 26:
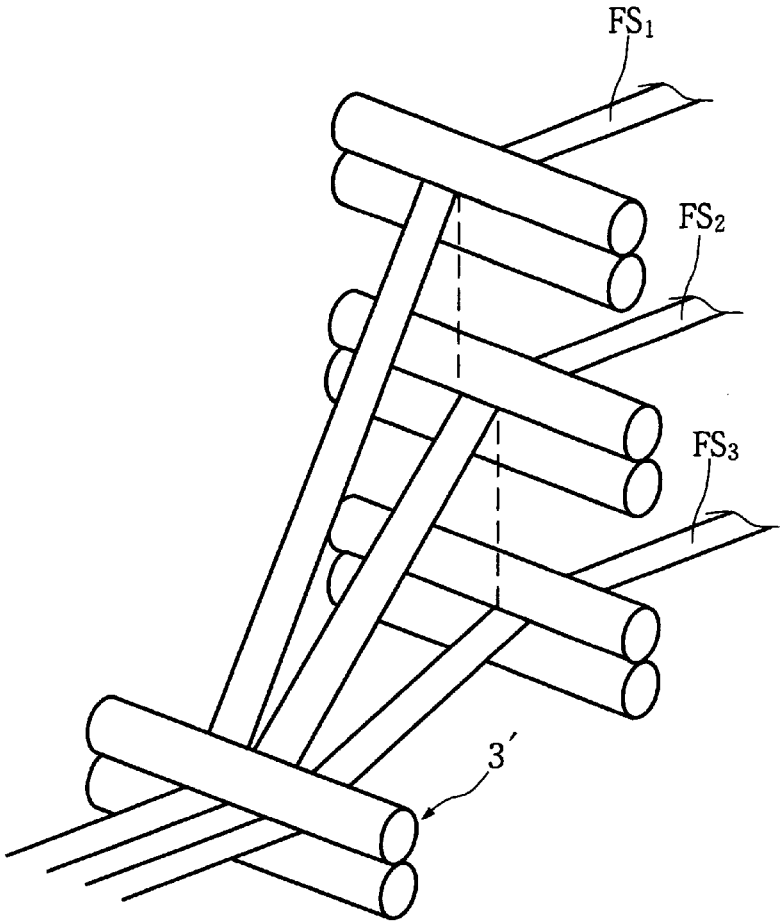
FIG. 26 is a perspective view showing the state where the fringe sides of plural multi-filament spread sheets to be supplied in multistage manner are adjacently disposed in parallel to each other so as to combine those sheets into integral structure.
Figure 27:
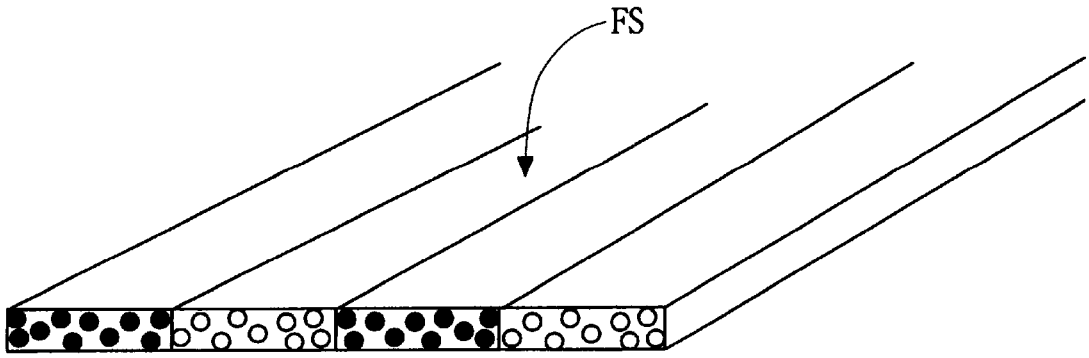
FIG. 27 is a perspective view of a complex multi-filament spread sheet produced by combining the plural spread sheets the fringe sides of which are adjacently disposed in parallel to each other into integral structure.

Likewise, by adjacently disposing the multi-filament spread sheets ($FS_1$), ($FS_2$) and ($FS_3$) sent from the first suction cavities (4), (4) and (4) side by side as shown in FIG. 26 and then introducing them into the second suction cavity (4), it becomes possible to obtain a wide complex multi-filament spread sheet where the fringe portions of those sheets ($FS_1$), ($FS_2$) and ($FS_3$) are combined into an integral body. Also in this case, it becomes possible to obtain various kinds of complex multi-filament spread sheets by selectively combining appropriate multi-filaments according to the purpose of use (refer to FIG. 27).

EXAMPLES OF COMPLEX MULTI-FILAMENT SPREAD SHEETS

If the number of feeding stages in the fifth embodiment of the present invention increases, it is also possible to perform the suction cavity (4) operation on such pileup multi-filament spread sheets as comprising ($FS_1$).($FS_2$) . . . (FSn).

Figure 28:
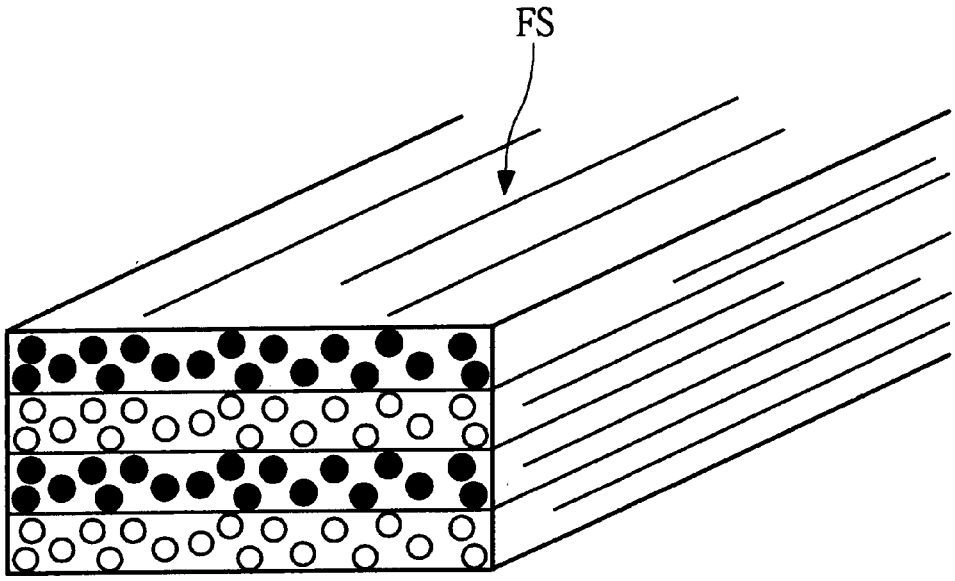
FIG. 28 is a perspective view showing a complex multi-filament sheet in an orderly multilayered status.

For instance, if multi-filament spread sheets comprising the selected types of multi-filaments which are piled up one over another in multistage status are subjected to the suction cavity (4) operation, such complex multi-filament spread sheet as having an orderly multilayered structure as shown in FIG. 28 can be obtained.

Figure 29:
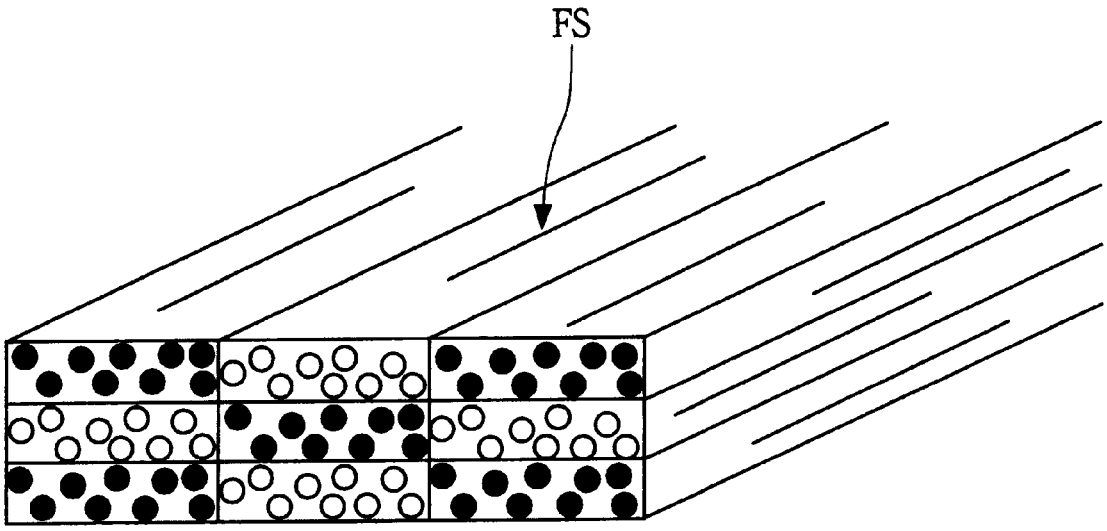
FIG. 29 is a perspective view of a multi-filament spread sheet of blend type where the fringe sides of plural types of multi-filament spread sheets are adjacently disposed in parallel to each other as well as those spread sheets are piled up one over another in an orderly multilayered status with a staggered pattern in section.

Likewise, it is also possible to produce a multi-filament spread sheet of blend type as shown in FIG. 29 where the fringe sides of the selected types of multi-filament spread sheets are combined together as well as those sheets are piled up one over another in an orderly multilayered status with a staggered pattern in section.

Figure 30:
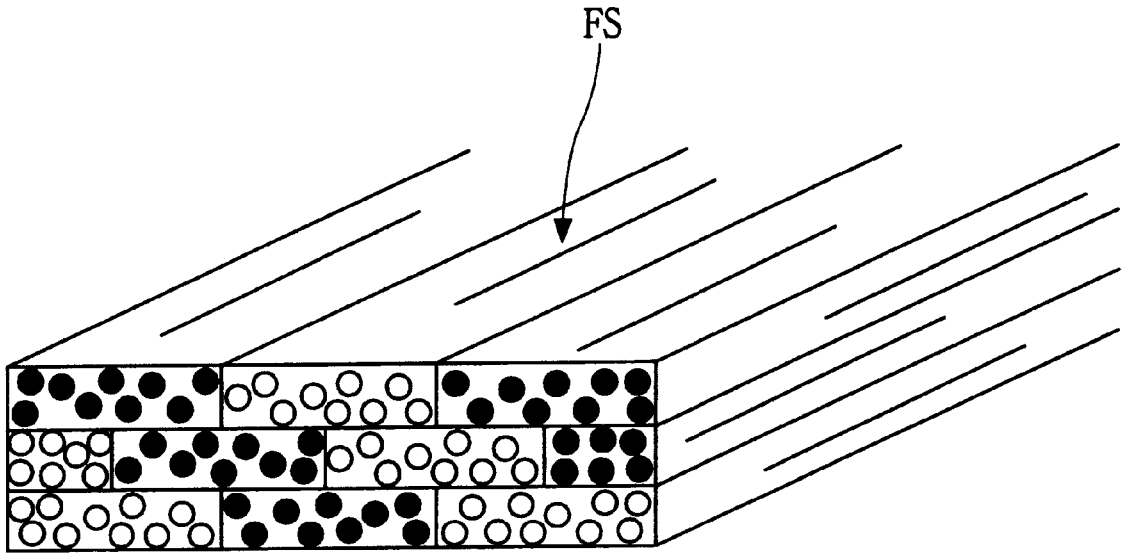
FIG. 30 is a perspective view of a multi-filament spread sheet of blend type where the fringe sides of plural types of multi-filament spread sheets are adjacently disposed in parallel to each other as well as those spread sheets are piled up one over another in a stepwise multilayered status.

Moreover, it is also possible to produce a multi-filament spread sheet of blend type as shown in FIG. 30 where the fringe sides of the selected types of multi-filament spread sheets are combined together as well as those sheets are piled up one over another in a stepwise multilayered status.

(Experiment)

Figure 31:
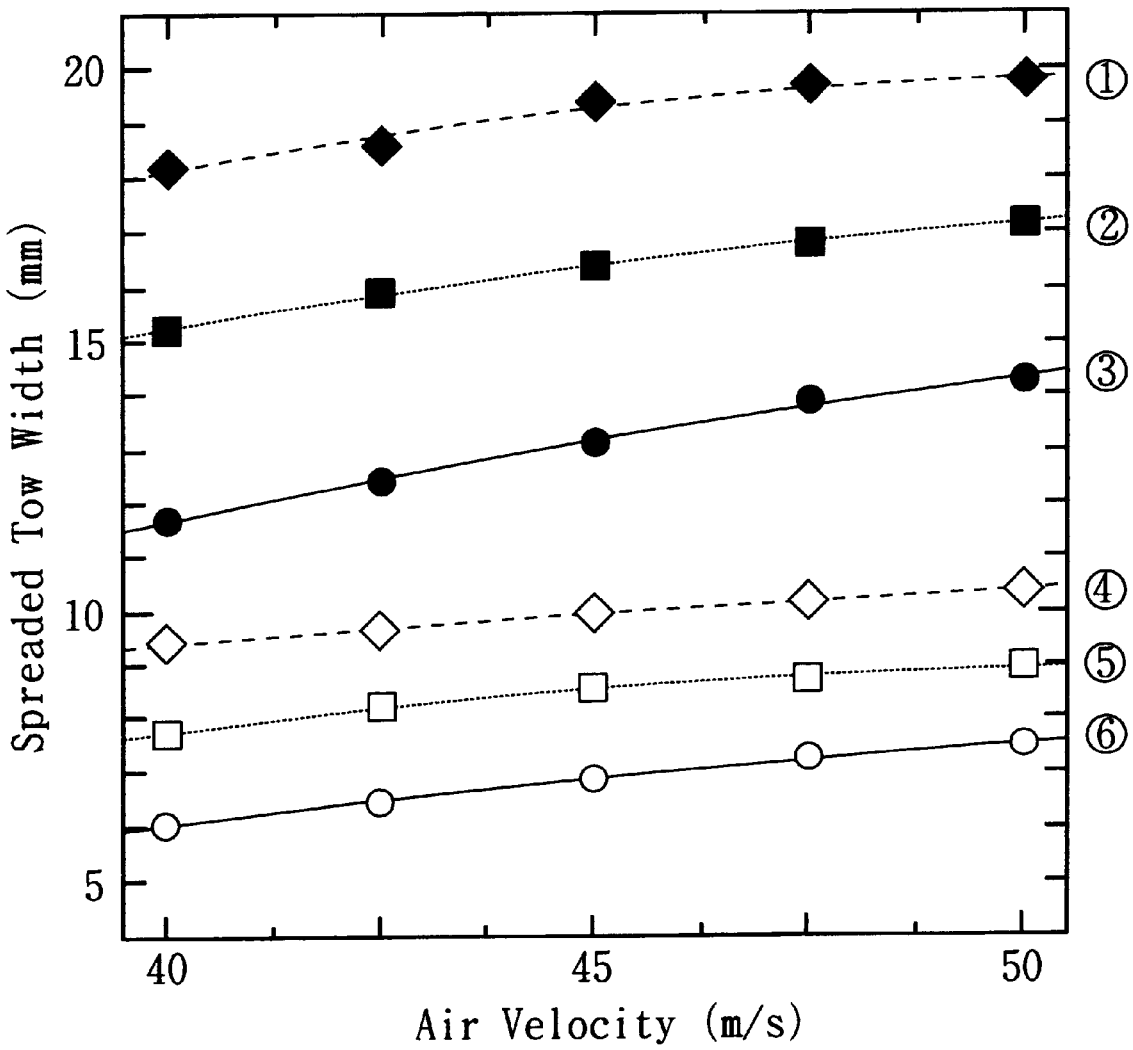
FIG. 31 is a graphic representation to show by numerical value the effectiveness of the multi-filament spread operation by means of the apparatus in the third embodiment.

In order to compare the capacity of the apparatus in the third embodiment of the present invention (hereinafter, referred as "the present apparatus") to spread a multi-filament in sheetlike shape with that of a series of rollers used for the preliminary extension mechanism (5) of the present apparatus, the effectiveness of spreading in sheetlike shape such two types of untwisted carbon fiber as comprising a bundle of 12,000 filaments (12K) and a bundle of 6,000 filaments (6K) each having 7 μm in diameter by means of the present apparatus is shown in FIG. 31 with a graphic representation. What is indicated with each line of ① to ⑥ in FIG. 31 is as follows.

① carbon fiber comprising 12,000 filaments whose spread width after the extension by the rollers is 10 mm and whose bending amount by the suction cavity operation is 8 mm.

② carbon fiber comprising 12,000 filaments whose spread width after the extension by the rollers is 10 mm and whose bending amount by the suction cavity is 6 mm.

③ carbon fiber comprising 12,000 filaments whose spread width after the extension by the rollers is 10 mm and whose bending amount by the suction cavity is 4 mm.

④ carbon fiber comprising 6,000 filaments whose spread width after the extension by the rollers is 5 mm and whose bending amount by the suction cavity is 8 mm.

⑤ carbon fiber comprising 6,000 filaments whose spread width after the extension by the rollers is 5 mm and whose bending amount by the suction cavity is 6 mm.

⑥ carbon fiber comprising 6,000 filaments whose spread width after the extension by the rollers is 5 mm and whose bending amount by the suction cavity is 4 mm.

It can be deducted from the graph shown in FIG. 31 that the greater the air velocity to the bundle of the filaments becomes as well as the larger the bending amount thereof becomes, the larger the spread width thereof becomes.

Then, the ratio of the spread width to the initial width of the multi-filaments by means of the apparatus embodied in the present invention is comparatively shown in FIG. 32 by taking as examples such two types of carbon fiber as comprising 6,000 filaments as well as 12,000 filaments where each filament has 7 μm in diameter and glass fiber comprising 2,000 filaments where each filament has 13 μm as well as 17 μm in diameter while the ratio of the spread width of the same multi-filaments as mentioned above to the initial width thereof by means of the conventional rollers is comparatively shown in FIG. 33.

It can be deducted from FIG. 32 that the spread width more than three times as large as the initial width can be realized with the apparatus embodied in the present invention while the spread width by means of the conventional rollers is limited to at most twice as large as the initial width as shown in FIG. 33. In other words, with the apparatus embodied in the present invention, the spread width about three to five times as large as the initial width can be realized so that the effectiveness of spreading a multi-filament in sheetlike shape by means of the present apparatus is far greater than that of the prior arts.

As having been described up to here, with the apparatus and method embodied in the present invention, because a multi-filament is spread in sheetlike shape by making most use of the synergistic effect between aerodynamic action and bending action the extent of which is controlled within a fixed range on the multi-filament, it becomes possible to produce a very wide and thin spread sheet made of various kinds of multi-filaments.

Likewise, with the apparatus and method embodied in the present invention, because a multi-filament is spread in sheetlike shape by subjecting the multi-filament to be over-supplied by a fixed amount to suction air so as to archly bend to the downstream side of air flow and spread widthwise, it becomes possible to produce a high-quality multi-filament spread sheet having no fluff on the surface, where not only there occurs no yarn cut on the filaments, but also the filaments each extending straight are orderly disposed in parallel to each other and with a fixed interval placed between adjoining filaments.

Then, with the apparatus and method embodied in the present invention, because such multi-filaments as carbon fiber, ceramic fiber and aromatic polyamide fiber can be widely and thinly spread in sheetlike shape, it becomes possible to efficiently mass-produce a multi-filament spread sheet excellent in resin impregnation and filament alignment which are indispensable for supplemental fiber materials for reinforcing a matrix such as a synthetic resin.

Moreover, with the apparatus and method embodied in the present invention, because various types of multi-filaments can be freely selected at one's disposal, it also becomes possible to produce a multi-filament spread sheet of blend type with unique property which was conventionally hard to obtain.

Furthermore, with the apparatus and method embodied in the present invention, it also becomes possible to efficiently produce a pileup multi-filament spread sheet by piling up the same or different types of multi-filament spread sheets one over another.

In this way, the present invention greatly innovates in multi-filament spread technology so that its industrial applicability is extremely high and wide in scope.

What is claimed is:

1. A method of producing a multi-filament spread sheet comprising the steps of:

oversupplying a multi-filament comprising plural filaments under feeding control from a yarn supply section to a yarn winding section, subjecting a moving multi-filament having a width and a thickness to air blowing substantially perpendicular to the width therewith so as to archly bend said multi-filament to a downstream side of the air flow, thereby, setting apart the filaments thereof widthwise from one another and transforming those filaments into a multi-filament spread sheet.

2. A method of producing a multi-filament spread sheet according to claim 1, further comprising using suction air to provide the air blowing substantially perpendicular to the width of the multi-filament.

3. A method of producing a multi-filament spread sheet according to claim 1, further comprising providing a suction cavity on a feeding course of the multi-filament between the yarn supply section and the yarn winding section which opens towards a moving multi-filament, and generating the air blowing substantially perpendicular to the width of said multi-filament by air suction of this suction cavity.

4. A method of producing a multi-filament spread sheet according to claim 1, further comprising the step of pressing the multi-filament supplied from the yarn supply section so as to be preliminarily extended widthwise before subjecting the surface of the multi-filament to suction air.

5. A method of producing a multi-filament spread sheet according to claim 1, wherein the multi-filament supplied from the yarn supply section to the winding section is repeatedly subjected to suction air.

6. A method of producing a multi-filament spread sheet comprising the steps of:

oversupplying a multi-filament comprising plural filaments under feeding control from a yarn supply section to a yarn winding section;

combining multi-filament spread sheets which are produced by a multi-filament spread operation where moving multi-filaments are subjected to air blowing crosswise therewith, into plural stages or disposing those sheets in parallel to each other; and further performing said spread operation on such multi-filament spread sheets as combined into plural stages or disposed in parallel to each other, thereby, producing a complex multi-filament spread sheet.

7. A method of producing a multi-filament spread sheet according to claim 6, wherein multi-filament spread sheets oversupplied by a feeding control are further combined in plural stages or disposed in parallel to each other and said spread operation is repeatedly performed on such multi-filament sheets which are further combined.

8. An apparatus for producing a multi-filament spread sheet having a width and a thickness comprising:

a means for oversupplying a multi-filament under feeding control;

a suction cavity arranged in such a manner that said cavity opens towards a feeding course substantially perpendicular to the width of said multi-filament between a yarn supply section and a yarn winding section; and wherein the cavity continuously subjects said multi-filament to suction air which archly bends and spreads said multi-filament.

9. An apparatus for producing a multi-filament spread sheet according to claim 8, wherein the oversupplying of a multi-filament on the feeding course positioned both anterior and posterior to the suction cavity is controlled by a control signal output by a bending sensor to detect how far a moving multi-filament above the suction cavity has bent.

10. An apparatus of producing a multi-filament spread sheet according to claim 8, wherein a yarn supply unit carrying a yarn supply section to release a multi-filament wound around the yarn supply section and feed the released multi-filament to a yarn winding section is rotatably arranged with regard to the feeding course of the multi-filament in such a manner that a winding direction of the multi-filament at the yarn supply section immediately before being released therefrom aligns the feeding course of the multi-filament, the yarn supply section being arranged on the yarn supply unit so that it can axially move back and forth thereon.

11. An apparatus of producing a multi-filament spread sheet according to claim 8, wherein a preliminary extension mechanism is arranged on the feeding course of the multi-filament so as to cause the multi-filament going through said extension mechanism to be preliminarily extended.

12. An apparatus for producing a multi-filament spread sheet comprising:

a yarn supply unit carrying a yarn supply section for rotatably feeding a course of a multi-filament having plural filaments between a yarn supply section and a yarn winding section, wherein a winding direction of the multi-filament at the yarn supply section immediately before being released therefrom aligns the feeding course of the multi-filament released from the yarn supply section, and said yarn supply section is arranged on said yarn supply unit so that it can axially move back and forth thereon;

a preliminary extension mechanism to preliminarily extend the multi-filament supplied from the yarn supply unit;

a feeding control mechanism to control the multi-filament preliminarily extended by said extension mechanism so that said multi-filament is oversupplied by a certain amount;

a suction cavity to perform a multi-filament spread operation by archly bending the multi-filament oversupplied by a certain amount under the feeding control mechanism in such a manner that said multi-filament is continuously subjected to suction air, wherein the multi-filament is spread into the filaments and transformed into the multi-filament spread sheet;

a yarn winding section to wind up the multi-filament spread sheet on which said spread operation by means of the suction cavity is performed.

13. An apparatus for producing a multi-filament spread sheet comprising at least one suction cavity disposed in a moving course of a multi-filament between a yarn supply section and a yarn winding section;

an oversupply control means to check how far the multi-filament has bent in this suction cavity.

14. An apparatus for producing a multi-filament spread sheet comprising:

a yarn supply unit carrying a supply means of a multi-filament, said unit aligning the releasing direction of a multi-filament unwound from said supply means with the moving direction thereof towards a yarn winding means by rotating and moving back and forth said supply means;

an extension mechanism to press a multi-filament to be fed from said supply unit and extend the same to the width direction thereof;

at least one suction cavity disposed in the moving direction of an extended multi-filament;

an oversupply control means to check how far said multi-filament has bent in this suction cavity.

* * * * *